United States Patent [19]

Breslow et al.

[11] 4,363,484

[45] Dec. 14, 1982

[54] ELECTRONIC TABLE TENNIS GAME APPARATUS

[75] Inventors: Jeffrey D. Breslow, Highland Park, Ill.; Rex M. Harper, Portland, Me.; David A. Glickson, Chicago, Ill.

[73] Assignee: Marvin Glass & Associates, Chicago, Ill.

[21] Appl. No.: 208,192

[22] Filed: Nov. 19, 1980

[51] Int. Cl.[3] ..... A63F 7/06

[52] U.S. Cl. ..... 273/85 G; 273/312

[58] Field of Search ..... 273/85 G, 85 R, 310, 273/311, 312, 313; 434/18, 19, 20, 21, 22

[56] References Cited

U.S. PATENT DOCUMENTS

| | | | |
|---|---|---|---|
| 3,054,614 | 9/1962 | Dean | 273/374 |
| 3,083,474 | 4/1963 | Knapp | 273/310 |
| 3,104,478 | 9/1963 | Strauss et al. | 273/310 |
| 3,434,226 | 3/1969 | Schaller | 273/311 |
| 3,499,650 | 3/1970 | Lemelson | 273/310 |
| 3,508,751 | 4/1970 | Meyer et al. | 273/310 |
| 3,898,747 | 8/1975 | Marshall | 434/22 |
| 3,956,627 | 5/1976 | Kikuchi et al. | 273/310 |
| 4,063,368 | 12/1977 | McFarland et al. | 434/22 |
| 4,086,711 | 5/1978 | Gammarino et al. | 434/22 |
| 4,102,532 | 7/1978 | Van Jepmond et al. | 273/311 |
| 4,111,421 | 9/1978 | Mierzwinski | 273/85 G |
| 4,150,825 | 4/1979 | Wilson | 273/195 A |
| 4,192,507 | 3/1980 | Rains et al. | 273/311 |
| 4,281,833 | 8/1981 | Sandler et al. | 273/85 G |

*Primary Examiner*—Vance Y. Hum
*Assistant Examiner*—Leo P. Picard
*Attorney, Agent, or Firm*—McDermott, Will & Emery

[57] ABSTRACT

A player response game is provided including game apparatus that directs light beams of relatively short duration from a control housing to opposing player stations and detects light reflected back from the respective player stations. The game apparatus also includes a hand held, light reflecting paddle for the player at each station, these paddles having a light diffusing surface so that light is reflected back to the control housing when the paddle intercepts a light beam irrespective of the exact angle at which the paddle intercepts the beam. The sequencing and control of the game apparatus by electronic control circuitry including a microprocessor simulates a table tennis game wherein a light beam is directed to either the forehand or the backhand side of the opposite station if a player at one station successively intercepts a beam with his paddle during the time the beam is directed to his or her station.

66 Claims, 7 Drawing Figures

GAME SELECT SWITCH
62
PIC 1655
MCLR
OSC
RC7
RC6
RC5
RC4
RC3
RC2
RC1
RC0
RB7
RB6
RB5
VDD
VXX
VSS
RA0
RA1
RA2
RA3
RB0
RB1
RB2
RB3
RB4
555
9V
6V
L1
L2
L3
L4

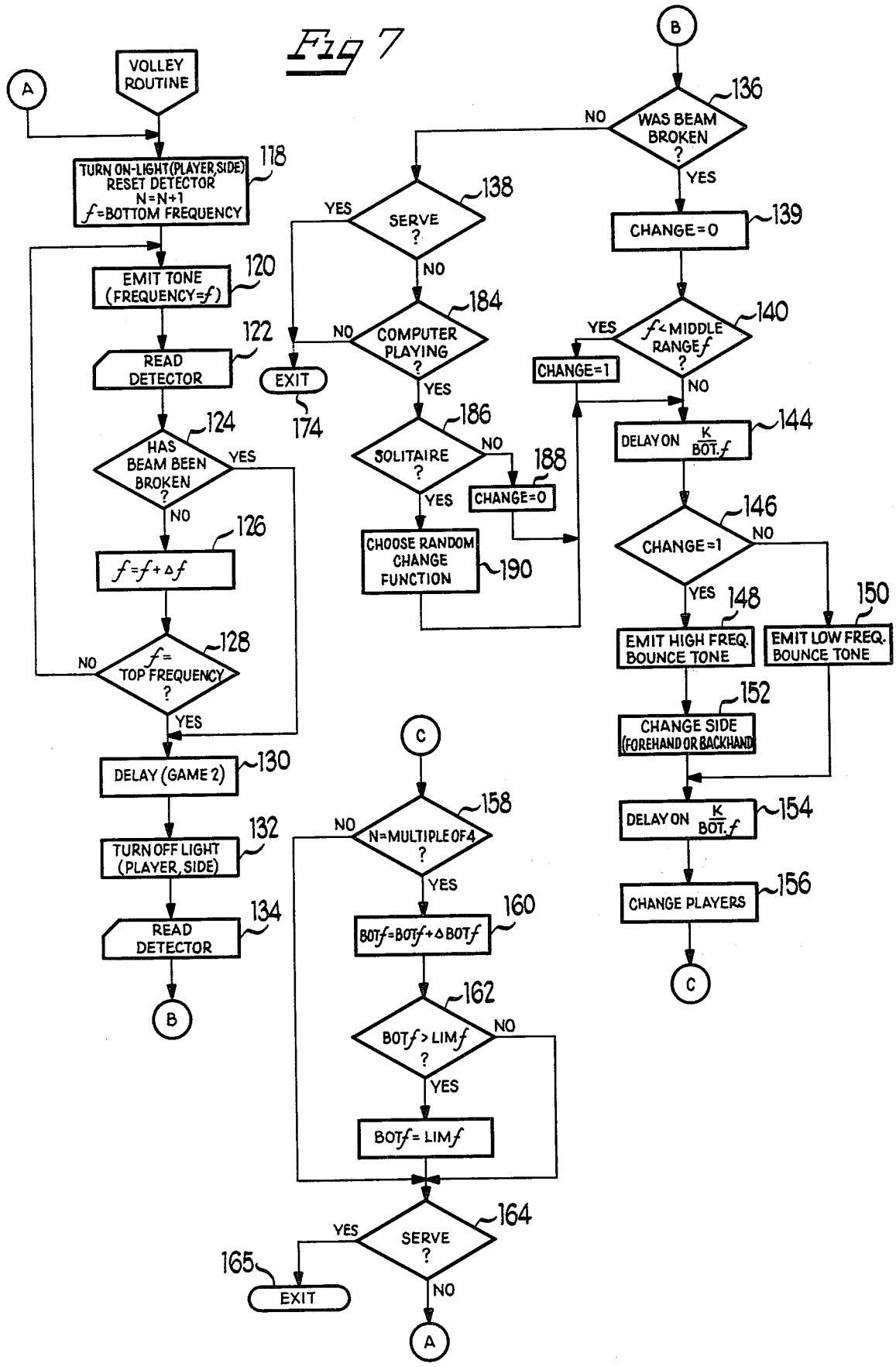
Fig 7
A
VOLLEY ROUTINE
TURN ON-LIGHT(PLAYER,SIDE) RESET DETECTOR N=N+1 f=BOTTOM FREQUENCY
118
EMIT TONE (FREQUENCY=f)
120
READ DETECTOR
122
HAS BEAM BEEN BROKEN ?
124
YES
NO
f=f+Δf
126
f= TOP FREQUENCY ?
128
NO
YES
DELAY (GAME 2)
130
TURN OFF LIGHT (PLAYER, SIDE)
132
READ DETECTOR
134
B
B
WAS BEAM BROKEN ?
136
NO
YES
SERVE ?
138
YES
NO
EXIT
174
COMPUTER PLAYING ?
184
NO
YES
SOLITAIRE ?
186
NO
YES
CHANGE=0
188
CHOOSE RANDOM CHANGE FUNCTION
190
CHANGE=0
139
f< MIDDLE RANGE f ?
140
YES
NO
CHANGE=1
DELAY ON K/BOT.f
144
CHANGE=1
146
NO
YES
EMIT HIGH FREQ. BOUNCE TONE
148
EMIT LOW FREQ. BOUNCE TONE
150
CHANGE SIDE (FOREHAND OR BACKHAND)
152
DELAY ON K/BOT.f
154
CHANGE PLAYERS
156
C
C
N=MULTIPLE OF 4 ?
158
NO
YES
BOTf=BOTf+ΔBOTf
160
BOTf > LIMf ?
162
NO
YES
BOTf= LIMf
SERVE ?
164
YES
NO
EXIT
165
A

ELECTRONIC TABLE TENNIS GAME APPARATUS

BACKGROUND OF THE INVENTION

A. Field of the Invention

The invention relates generally to player response games and more particularly to game apparatus providing the direction of light beams toward one or more game players and a reflection of light beams by the players by means of hand held light reflecting paddles.

B. Description of the Prior Art

Various target aiming games are known wherein one or more players respond to targets or time signals and aim devices such as pistols or rifles toward the target with game apparatus detecting the proper aiming and timing of the player response.

For example, U.S. Pat. Nos. 3,054,614, 3,956,627, 4,102,532, and 4,192,507, are directed to arcade or shooting gallery type games. Further, U.S. Pat. No. 4,150,825 is directed to a golf game simulating apparatus wherein a player drives a golf ball toward a curved target screen in front of a tee area and optical sensing devices are positioned to accurately assess the trajectory of the golf ball. A first type of these games provides for light beam shooting or aiming and a target for detecting the light beam. The second type of these games for video game arrangements includes the detection in the aiming apparatus of various illumination areas from a video screen.

BRIEF SUMMARY OF THE INVENTION

A player response game is provided including game apparatus that directs light beams of relatively short duration from a control housing to opposing player stations and detects light reflected back from the respective player stations. The game apparatus also includes a hand held, light reflecting paddle for the player at each station, these paddles having a light diffusing surface so that light is reflected back to the control housing when the paddle intercepts a light beam irrespective of the exact angle at which the paddle intercepts the beam. The sequencing and control of the game apparatus by electronic control circuitry including a microprocessor simulates a table tennis game wherein a light beam is directed to either the forehand or backhand side of the opposite station if the player at one station successfully intercepts the beam with his paddle during the time the beam is directed to his station. A further element of skill is introduced by developing an audible signal of increasing frequency whose duration coincides with the light beam. If a player intercepts the beam during the first half of the audible signal the microprocessor directs the beam to the opposing player's opposite side whereas if a player intercepts the beam during the last half of the audible signal the microprocessor directs the beam to the same side (either backhand or forehand) of the opposing player as the side on which the beam was intercepted by the first player. By timing this interception of a beam coming to either his forehand or his backhand in relation to the audible signal a player can make it more difficult for the opposing player to intercept the beam when it is directed to him.

In order to prepare a player to intercept a beam, a delayed bounce tone signal is generated after the beam has been intercepted at one station and before a beam is directed to the opposite station which simulates the delay in an actual table tennis or tennis game between the time one player hits the ball and the time it arrives at the other player's side. Furthermore, the bounce tone signal has a high frequency if the opposing player has intercepted his beam during the first half of the audible signal and a low frequency if the opposing player has intercepted his beam during the last half of the audible signal. The frequency of the bounce tone signal thus serves to inform a player whether his beam will come to the same side (forehand or backhand) as the side on which the opposing player intercepted his beam or will come to him on the opposite side. In one arrangement the play of the game is controlled in accordance with conventional table tennis rules providing for serves and volleys with points scored for missed returns of serves and volleys. In another arrangement, one player may practice against the microprocessor and the beams is always returned to the player on the same side that he directed the beam to the imaginary opposing player. In a third arrangement, a single player may play against the microprocessor but the microprocessor randomly changes the side on which the beam is returned to the player to simulate an actual opposing player who never misses intercepting the beam at his station.

With all these game arrangements the tempo of the game is steadily increased by shortening the time duration of the light beam and accompanying audible signal, as well as the delays before and after the bounce tone signal so that it becomes increasingly difficult for the players to keep a volley going. If one player fails to intercept his beam, each players score is announced and another point is started by serving to the side on which the player missed intercepting the beam.

It is an object of the present invention to provide a new and improved player response game apparatus which includes means for selectively generating beams of radiant energy which are aimed in different directions relative to a player station, means for detecting radiant energy which is reflected back from a hand held object which intersects one of said beams to a location adjacent the source of said one beam, and means responsive to said detecting means for controlling said selective beam generating means to generate a different one of said radiant energy beams.

It is another object of the present invention to provide an electronic table tennis game apparatus wherein a housing is positioned between opposing player stations and means are provided within the housing for directing a light beam to either the forehand or backhand side of a player at either of said player stations, means operative during a serving mode for controlling said beam directing means so that a beam of relatively short duration is repetitively directed to one side of a player at the first one of said stations, and means operative during a volley mode and responsive to interception of said short duration beam by a player at said one station for controlling said beam directing means to direct a light beam of relatively short duration to the opposite player station.

BRIEF DESCRIPTION OF THE DRAWINGS

FIG. 7 is a flow chart of the volley subroutine employed in the flow chart of FIG. 6 and further illustrates the manner in which the microprocessor of the present invention is programmed.

Figure 1:
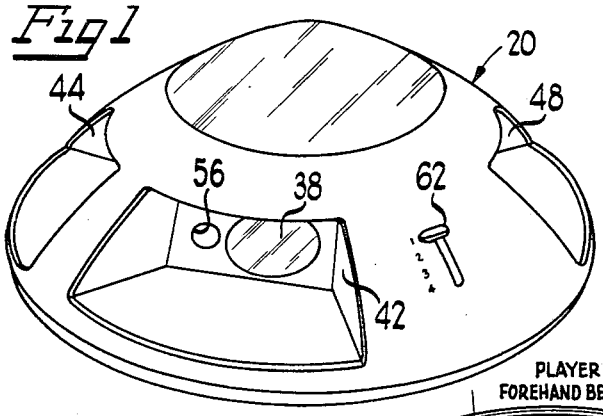
FIG. 1 is a perspective view of the game apparatus of the present invention.

Referring now to the drawings, the game apparatus of the present invention comprises a central housing indicated generally at 20 which is arranged to be placed at table height between two opposing player stations identified as player A and player B. Within the housing 20 there is provided means for directing a light beam of relatively short duration to either the forehand or backhand side of each player station. Thus, the housing 20 contains a first light generating means indicated generally at 22 which is arranged to direct a light beam indicated at 24 which extends outwardly from the housing 20 on the forehand side of player A. Similarly, a light source 26 also positioned within the housing 20 is arranged to direct the light beam 28 outwardly from the housing 20 on the backhand side of the player A station. Similar light sources within the housing 20 are also arranged to direct the light beams 30 and 32 to the forehand or backhand side, respectively, of the player B station. Preferably, each of these light sources comprises a light bulb 34 and parabolic reflector 36, the light bulb 34 being of the PAR type in which the filament is positioned relative to the parabolic reflector 36 so that a well defined, tight, light beam 24 is projected through the oval shaped cover 38. Each light source, such as the light source 22 is preferably mounted on the rear wall 40 of an outwardly directed recess 42 in the housing 20 so that the light sources which are visible to one of the players are not also visible to the opposite player. A similar recess 44 is provided in the housing 20 for the light source 26 and the recesses 46 and 48 are provided for the forehand and backhand light beam sources, respectively, of the player B station. The light beams 24, 28, etc. are preferably shaped so that they have a width of a foot or so at a distance of one or two feet from the housing 20.

Figure 2:
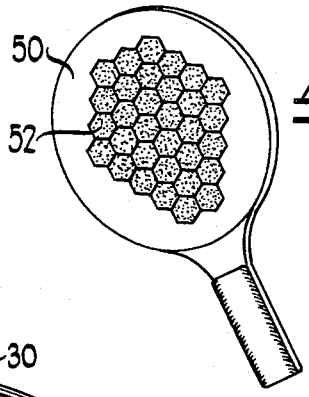
FIG. 2 is a perspective view of a hand held paddle used by the players in the game of FIG. 1.
Figure 3:
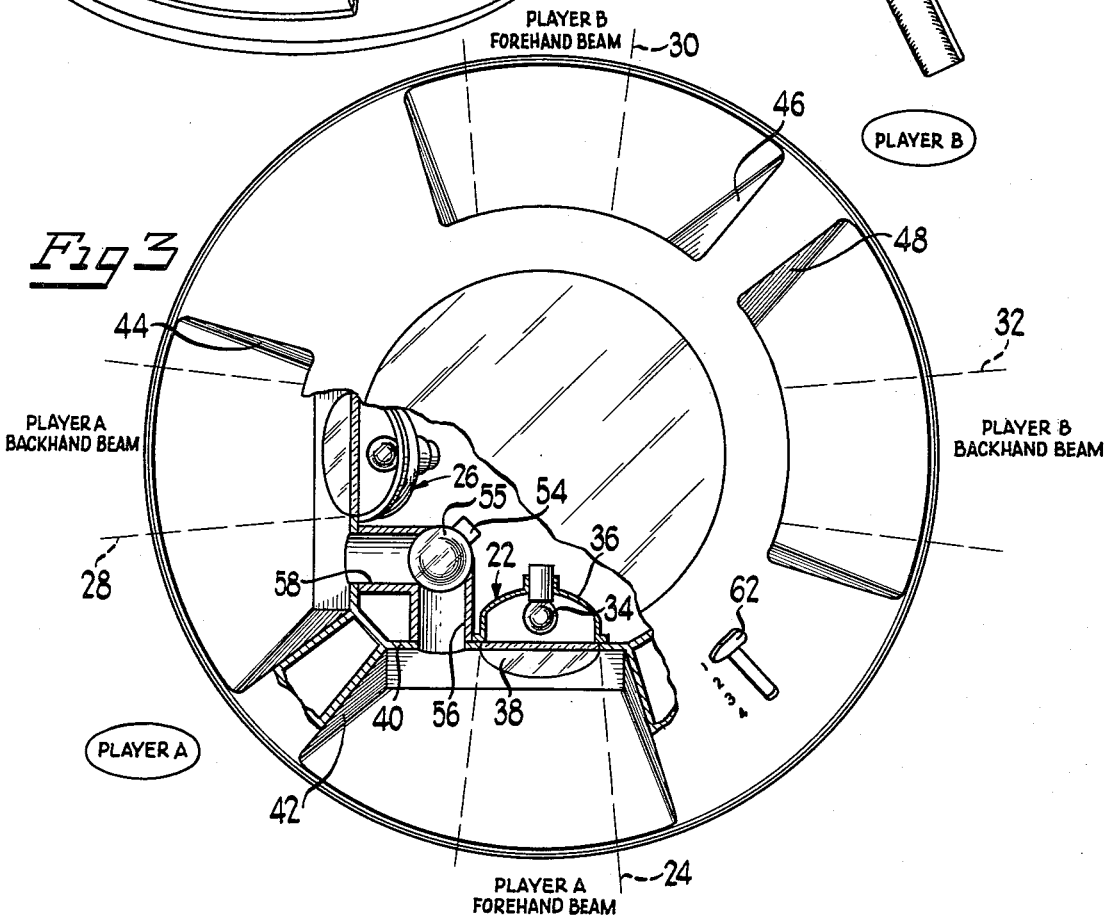
FIG. 3 is a top plan of the game apparatus of FIG. 1 and showing the locations of the players relative to the light beams directed to each player.
Figure 4:
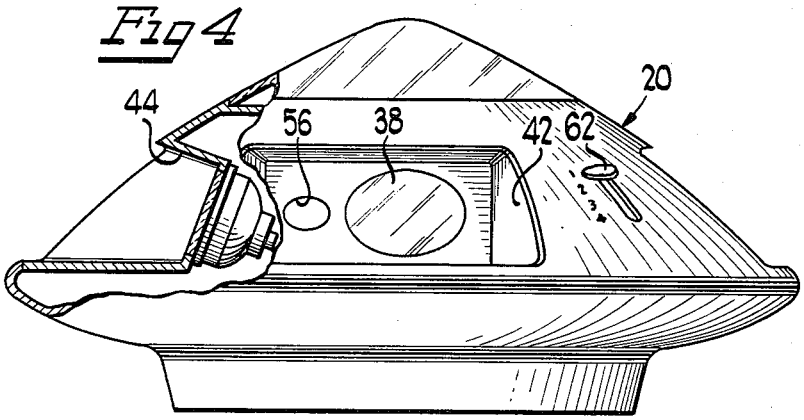
FIG. 4 is a side elevational view of the apparatus of FIG. 3.

During normal play of the game, the players stand a foot or two away from housing 20 and each player is provided with a hand held paddle 50 (FIG. 2) which is provided with a light diffusing surface 52 on either side thereof. If, for example, the light beam 24 is projected out of the housing 20 on the forehand side of player A, he may move his paddle 50 so as to intercept the light beam 24 and reflect some of the light from this beam back to the housing 20. A light sensitive detector 54 is provided within the housing 20 which communicates with the recesses 42 and 44 via the tubes 56 and 58, respectively through an air space or a lens such as the spherical lens 55 which directs the beam to the detector 54. Accordingly, when light from the beam 24 is reflected off player A's paddle back to the housing 20 some of this light strikes the photodetector 54, thus signifying that player A has intercepted the beam 24. In a similar manner if the light beam 28 is directed to player A's backhand he may also intercept the beam 28 with his paddle and reflect some of the light thereof back through the tube 58 to the photodetector 54 so that an indication is provided that the beam 28 has been intercepted by player A. A similar photodetector **54*a* (FIG. 5) is also provided in the housing 20 to receive light reflected back to the housing from either of the beams 30, 32** at player B's station when player B intercepts either of these beams.

Preferably, the light diffusing surface 52 on either side of the paddle 50 comprises light reflective tape, of the type manufactured by Minnesota Mining & Manufacturing Co. which is used on bicycles and roadside signs, this tape incorporating light reflecting granules whicn reflect light in all directions from the surface of the paddle 50. With such a light diffusing surface, some light is reflected back to the light detector 54 irrespective of the exact angle at which the player intercepts the beam with his paddle. If the light reflective surface of the paddle 50 is not light diffusing, it would be extremely difficult for the player to position his paddle at exactly the right angle to reflect light back to the photodetector 54 during the brief duration of the light beam 24. However, it will be understood that any suitable type of light diffusing or reflecting surface can be used for the paddles 50 provided sufficient light is reflected back to the photodetector 54 to provide an indication when a player intercepts one of the light beams.

Considering generally the manner in which the electronic table tennis game of the present invention is played, initially a serving mode is established in which a light beam of short duration is repetitively directed to one of the player stations at spaced intervals to start the game. For example, a light beam 24 of short duration would be directed to player A's forehand at spaced intervals until player A interposes his paddle 50 in one of these beams and reflects light back to the photodetector 54. When this occurs a volleying mode is established and a light beam is then directed to either the forehand or backhand side of the player B station and player B must intercept this light beam with his paddle before the beam is extinguished. If he is successful in intercepting his light beam a light beam is then directed to either the forehand or backhand of player A who must then intercept the light beam before it is extinguished. The play continues with each player being required to intercept his light beam in order to keep the ball in play. If a player fails to intercept his light beam before it is extinguished he loses a point in the game.

In accordance with an important aspect of the present invention an audible signal is produced concurrently with the direction of each light beam to one of the players. This audible signal preferably comprises a series of tones of successively higher frequency which are produced in rapid succession so as to give a so-called "whoop" signal. The bottom frequency of this "whoop" signal is developed at the time the light beam is initiated and the light beam is extinguished when the top frequency of the "whoop" signal is produced. By listening to the whoop signal the player can gain some indication of the total duration of the light beam and hence may time the point at which he intercepts the light beam so that his interception can be made either during the first half of the audible signal which coincides when the first half of the coincidently produced light beam, or during the last half of thus audible signal. As soon as the player intercepts the beam the audible "whoop" signal is terminated and his light beam is extinguished. If he intercepts the beam during the first half of the audible signal the control apparatus provided within the housing 20, which includes the microprocessor 60 (FIG. 5) described in more detail hereinafter, senses this condition by noting the frequency at which the "whoop" signal was terminated and determining that this frequency occurred during the first half of the total audible "whoop" signal. The microprocessor 60 then directs a light beam to the side of player B which is opposite from the side on which player A intercepted the beam. For example, if player A intercepts the beam 24 during the first half of the audible signal the light beam 32 will thereafter be directed to player B's backhand side. On the other hand, if player A intercepts his backhand beam 28 during the first half of the audible signal the microprocessor 60 will function to direct the beam 30 to player B's forehand. If, however, player A intercepts his beam 24 during the last half of the audible cycle the microprocessor will function to direct a beam to the same side of player B, i.e., his forehand beam 30. In a similar manner if player A intercepts the backhand beam 28 during the last half of the audible signal the beam 32 is thereafter directed to player B's backhand side.

In order to make the game more difficult, after each series of four volleys, i.e., successive interceptions of the beam by the players, the duration of the light beam and the accompanying audible signal is shortened by a predetermined increment so that the players have less and less time within which to intercept the beam with their paddle. Preferably, this shortening of the audible signal is accomplished by starting the audible signal at a higher bottom frequency so that the "whoop" starts at a higher frequency and proceeds to the same top frequency. The light beam is then extinguished when the top frequency of the "whoop" signal is produced or when one of the players intercepts the light beam with his paddle. This increase in the tempo of the volleys is increased until the bottom frequency of the audible signal reaches an upper frequency limit beyond which the durations of the audible signal and light beam are not further shortened but continue at that duration until one of the players fails to intercept his light beam.

Since the light beams may become very short and each player may change the direction in which the beam will be directed to his opponent by intercepting the beam during either the first half or the last half of the audible signal, it would be extremely difficult for the opposing player to intercept his beam if he has to rely solely on his visual perception of the beam as it is directed to him and bring his paddle to the correct side to intercept the beam. In accordance with an important apsect of the present invention each player is given time to prepare himself for the interception of his beam when it is directed to him and is also provided with an audible indication of whether the beam will be directed to his forehand or backhand side. More particularly, after one of the players has intercepted his beam, a delay interval is provided after which a bounce tone signal is generated, this bounce tone signal having a high frequency if the other player has intercepted his beam during the first half of the audible signal and having a low frequency if the other player has intercepted his beam during the last half of the audible signal. A second delay interval is then provided after the bounce tone signal so that the player to whom the next beam will be directed has time to prepare himself to intercept the beam on the correct side. In this connection it will be noted that the bounce tone signal does not simply identify which side the beam will be directed to but rather identifies whether or not the other player has intercepted his beam during the first half or the last half of the audible signal. In other words, the player to whom the beam will be directed has to note on which side the other player has intercepted the beam and then listen for the bounce tone signal to see whether or not his beam will be directed to him on the same side as the side on which the beam was previously intercepted or on the opposite side.

A game switch 62 is provided on the side of the housing 20 by means of which any one of four different games may be selected. In Game No. 1 two players play the game and are positioned at the opposing player stations A and B. In this game the duration of each light beam is exactly the same as the audible "whoop" signal. In other words, the light beam is terminated when the top frequency of the "whoop" signal is generated so that both the "whoop" signal and light beam are terminated at the same time.

In Game No. 2, i.e., position 2 of the switch 62, two players again play the game but the light beams are left on for a somewhat longer time than the audible "whoop" signal. This means that each player is given a somewhat longer time in which to intercept the beam and maintain the volley without losing a point. Accordingly, Game No. 2 may be considered a two player game of somewhat lower skill level. In this connection it will be noted that the beams for a particular player station are directed out of the housing 20 at substantially 90° to one another so that they rapidly diverge with respect to a player who stands midway between the two beams. Normally, the players stand from one to two feet away from the housing 20 so that each player can readily interpose his paddle in either the forehand or backhand beam without moving his body very much. However, if it is desired to require a greater skill level for one player, he may be required to step back several additional feet. At this position the beams are widely separated and the player will have to move very quickly in order to intercept either the forehand or backhand beam and stay in the game, particularly when the duration of the beams is shortened, as described in detail heretofore.

In the third position of the game switch 62 a so-called practice mode is established wherein the microprocessor 60 functions to return the beam to a practicing player on the same side that the player has sent the beam to the opposing station. Thus, if player A is practicing and intercepts his forehand beam 24 during the last half of the audible signal the microprocessor sends a beam to the opponent's forehand which beam is not broken since there is no opposing player. After a suitable delay and emission of the bounce tone signal the microprocessor will then return a beam to the practicing player's forehand. On the other hand, if the practicing player intercepts his forehand beam during the first half of the audible signal a beam is sent to his opponent's backhand but this beam is not intercepted. The computer then after a suitable delay and emission of the bounce tone signal directs a beam to the practicing player's backhand.

In the fourth position of the game switch 62 a single player plays the game but plays it against the microprocessor 60 which randomly charges the return from forehand to backhand as would an opposing player but the microprocessor always intercepts the beam, i.e., never makes a mistake, so that the game progresses more and more rapidly until the solitary player is unable to intercept one of his beams. Accordingly, in Game No. 4 the solitary player gets an equivalent of practicing with a real player of extremely high skill level although the conventional game scoring is not provided.

When one of the players fails to intercept a beam directed to his forehand or backhand, a point is awarded to the other player. Furthermore, the microprocessor stores the score of each player and after each point the microprocessor indicates the score to each player by first flashing the forehand light beam of this player and then generating an audible tone signal which is coded to indicate the number of points that player has won. Preferably this coded audible signal comprises a high frequency beep tone indicating five points and one or more low frequency beeps indicating a single point. Thus, a score of eleven, which is usually designated as a game winning score, would consist of two high frequency beeps and one low frequency beep. Each player is thus informed after each point of his score in the game. When one of the players wins eleven points the game is over and the microprocessor announces the winner by alternately flashing the winner's forehand and backhand beams and sounding the audible "whoop" signal.

The electronic table tennis game of the present invention is preferably played in a darkened or semi-dark room so that the light beams 24, 28 etc. will be clearly visible to the players. However, it should be understood that other types of radiant energy beam emitters may be used in place of the light bulbs 34. For example, light emitting diodes which emit predominantly infra red light may be employed in place of the light bulbs 34 and the IR radiant energy from these LED's may be suitably shaped to provide the beams 24, 28, 30 and 32. The photodetector 54 and **54*a* may also be chosen to respond primarily to the IR light reflected from the paddles 50 of the players. Furthermore, the IR beams from the LED's may be coded by any suitable modulating means and the reflected modulated IR light can be decoded in any suitable arrangement so that the game of the present invention may be played in daylight or even out of doors because the coded reflected IR light can be distinguished from ambient light striking the detector 54 as will be readily understood by those skilled in the art. Similar IR beam transmitting and detecting arrangements have been employed for many years to control automatic door openers for the doors of supermarkets, and the like, which function to detect the presence of a person walking toward the door in bright sunlight. Also, other forms of radiant energy transmitters and receivers may be employed in place of the light beams 24, 28, 30 and 32, such as ultrasonic or microwave generators, provided the radiant energy from the transmitter can be suitably shaped into a beam which can be projected to either the forehand or backhand side of the player. If the radiant energy beams are invisible to the players the players can still be guided by the audible "whoop" signals in timing interception of the beam by their paddle and, with practice, can determine the boundaries of the invisible beam. However, it would be desirable to provide a visible indicator for each beam to inform each player which beam is on and the duration of the beam. Such indicators may comprise four LED's mounted above each of the recesses 42, 44, 46 and 48 in the housing 20 and energized by the micro-processor 60** concurrently with the radiant energy source which generates the invisible radiant energy beam.

Figure 5:
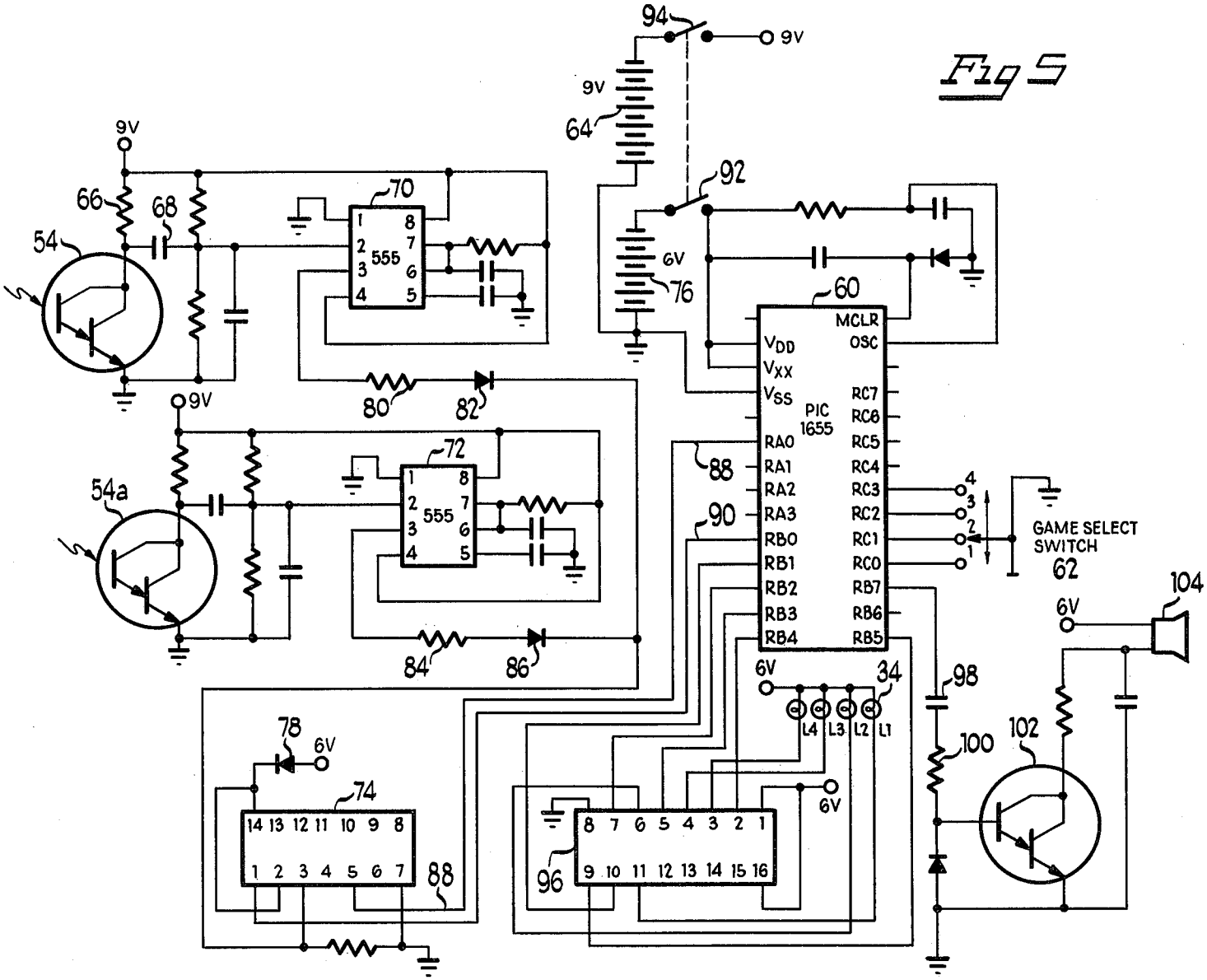
FIG. 5 is a schematic diagram of the electronic circuitry of the present invention.

Considering now the electronic circuitry shown in FIG. 5, all of which is contained within the housing 20, each of the light detectors 54 and **54*a* comprises a so-called photo-Darlington which provides a photo transistor in a Darlington type analog amplifier to provide a relatively large output signal in response to light reflected back to the detector from the paddle of one of the players. The photo-Darlington amplifier is energized from a nine volt battery 64 through the load resistor 66, the emitter of the second stage of the Darlington being connected to ground. The pulse output of the photo-Darlington is coupled through a capacitor 68 to the input of a timer 70 which may comprise a commercial type 555 integrated circuit, this timer being arranged to provide a relatively long pulse at the output terminal 3 thereof. In this connection it will be understood that the light reflected from a player's paddle when he intercepts one of the light beams 24, 28, etc. may be of extremely short duration since the player may simply slice through the beam in attempting to time his interception in a desired manner relative to the audible "whoop" signal. Accordingly, it is necessary to provide a pluse stretching or lengthening arrangement for the pulse output of the photo-Darlington to be sure that a player's interception of his beam is not missed. The light detector 54*a* comprises a similar photo-Darlington amplifier and timer 72**.

Since a light beam is directed only to one player at a time there can never be coincident outputs from the two photo-Darlingtons. Accordingly, the outputs of the two timers 70, 72 may be combined and are supplied to a latch circuit 74 so that interception of the beam is held until the microprocessor 60 needs to refer to it. Preferably the latch circuit 74 is of the commercial type 7474 and is energized from the six volt battery 76 through a diode 78 preferably of the commercial type 1N914, which drops the battery voltage down to the rated voltage of the chip 74. More particularly, the output of the timer 70 is supplied through the resistor 80 and the diode 82 to the input terminal 3 of the latch 74 and the output of the timer 72 is supplied through the resistor 84 and the diode 86 to this terminal. The latched beam interception signal is supplied over the conductor 88 to the RA0 input of the microprocessor 60. This latch is reset by the microprocessor which supplies the reset pulse to the output terminal RB0 and over the conductor 90 to the clear input terminal of the latch 74.

The microprocessor 60 is preferably of the commercial type PIC-1655. The microprocessor 60 is energized from the six volt battery 76 through the on-off switch 92, the switch 92 and the on-off switch 94 for the nine volt battery 64 preferably being ganged with the game select switch 62 so that when the game switch 62 is moved to the Game No. 1 position the switches 92 and 94 are closed.

The four fixed terminals of the game switch 62 are connected to the input terminals RC0, RC1, RC2 and RC3 of the microprocessor 60 and the microprocessor continually scans these inputs to determine which one is grounded so that the microprocessor is informed what game is to be played. Also, the microprocessor selectively provides output signals to the output terminals RB1, RB2, RB3 and RB4 corresponding to the four light bulbs 34 of the four light sources provided in the housing 20, these output signals being supplied to a driver chip 96 which is preferably of the commercial type 75494. The microprocessor also supplies a chip enable signal from its output RB5 to the enabling input terminal 9 of the chip 96 when one of the lamps 34 is to be selectively energized. The various audible signals, such as the "whoop" signal and the bounce tones signals are supplied to the output terminal RB7 of the microprocessor 60 and through a capacitor 98 and resistor 100 to the input of a Darlington amplifier 102 which drive the loudspeaker 104.

Figure 6:
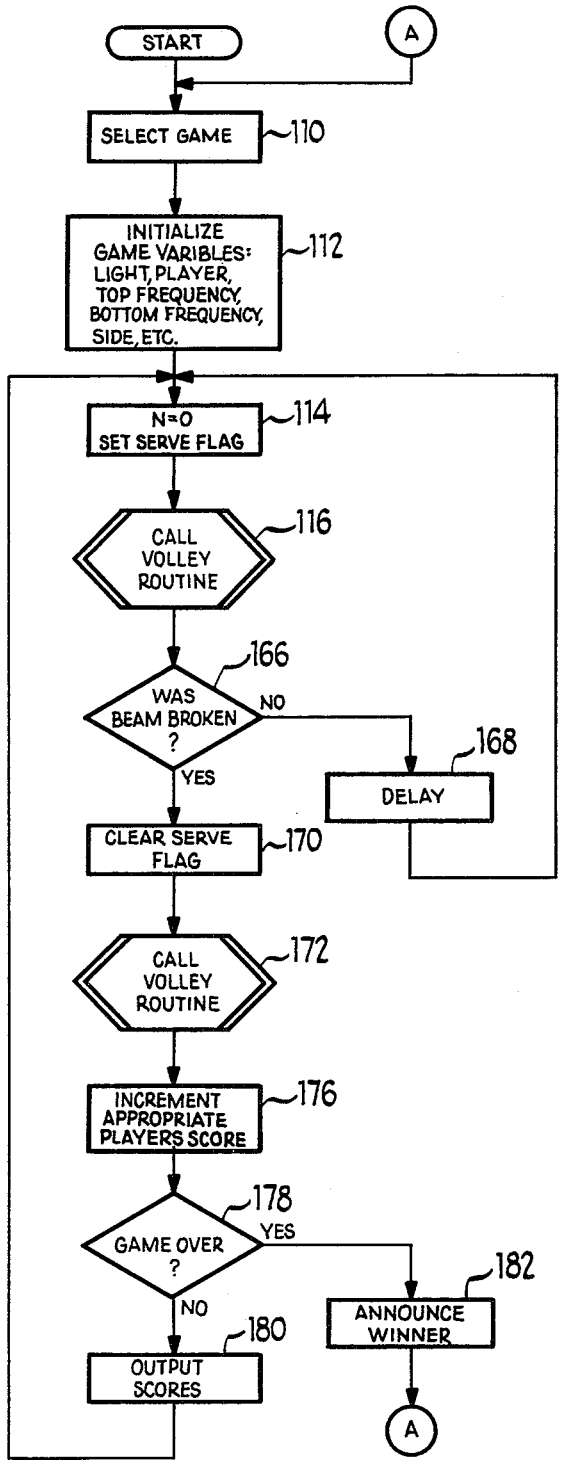
FIG. 6 is a flow chart illustrating the manner in which the microprocessor of FIG. 5 is programmed in accordance with the present invention.

Referring now to FIGS. 6 and 7 which comprise the flow chart in accordance with which the microprocessor 60 is programmed so as to perform the functions of the electronic table tennis game of the present invention, when the game switch 60 is turned on, the microprocessor determines the particular game setting of the switch 62 as indicated by the block 110 and initializes the game variables, as indicated by the block 112. As stated heretofore, each game is preferably started by establishing a serving mode in which a light beam of short duration is directed to a particular player's forehand, such as player A at spaced intervals until that player intercepts the beam so as to initiate a volley routine. Accordingly, the initialized game variables might consist of player A, for example, player A's forehand light source which generates the forehand beam 24 and the top and bottom frequencies of the audible "whoop" signal.

After these game variables have been initialized, a serve flag is set, as indicated by the block 114 and the volley subroutine shown in FIG. 7 is called up, as indicated by the block 116. Referring to FIG. 7, when the volley subroutine is called for the light on the selected side of the selected player is turned on, as indicated by the block 118. At the same time any latched detector signals are cleared in the latch 74 by transmitting a clear signal over the conductor 90. Also, the count N of a counter which was initially set to zero when the serve flag was set, is now set to one and the frequency of the audible "whoop" signal is set to the preassigned bottom frequency such as 400 Hz. The counter N keeps track of the number of volleys, i.e., the number of times successive players have successfully intercepted their light beam in succession.

During the serving mode the light bulb 34 would be turned on so as to emit the light beam 24 on the player A's forehand. The microprocessor 60 then proceeds to emit a tone equal to the selected bottom frequency, as indicated by the block 120 and then reads the photodetector 54, as indicated by the block 122 to determine whether the beam has been broken, as indicated by the decision block 124. If the beam has not been broken by interception of the beam by player A's paddle and reflection of light back to the photodetector 54, the microprocessor adds a predetermined delta f increment to the tone frequency as indicated by the block 126. The microprocessor then determines whether the frequency has reached the predetermined top frequency of the audible "whoop" signal, as indicated by the decision block 218. If the top frequency has not been reached the new tone frequency is emitted, the detector read, and delta f again added to the frequency. Accordingly, if the beam is not broken the audible "whoop" signal is produced by adding delta f increments to the bottom frequency at a relatively rapid rate so that the top frequency, which may be 3600 Hz, is reached within approximately 0.33 seconds. Accordingly, the audible "whoop" signal has a duration of approximately 0.33 seconds and increases in frequency from 400 Hz to 3600 Hz over this time period. Preferably the delta f increments are quite small, such as 50 Hz, so that the "whoop" signal is a sliding sound rather than a series of musical tones.

If the beam is broken at any time during the "whoop" signal the decision block 124 provides a yes output which is supplied through the delay block 130, which is used only for Game No. 2, so that the light beam 24 is extinguished as indicated by the block 132. Also, as soon as the beam is broken the tone frequency f is held by the microprocessor at the frequency at which the beam was broken. If Game No. 2 has been selected a short delay period is provided, as indicated by the block 130 before the light beam is turned off and even though the top frequency of the "whoop" signal has been reached and the "whoop" signal terminated. Thus, in Game No. 2 the player is given an additional time period within which to intercept his light beam. The photodetector 54 is again read after the light is turned off, as indicated by the block 134, to determine if the player intercepted his light beam after the audible signal was terminated in Game No. 2.

As discussed generally heretofore, if the beam is not broken by player A during the first "whoop" signal, or during the delay period following this "whoop" signal during Game No. 2, this same beam is again directed to player A's forehand successively until he is successful in intercepting the beam and thus starting the game by causing the microprocessor to direct a light beam to his opponent. More particularly, if player A has not broken his beam the decision block 136 provides a No output which then goes to the decision block 138 which provides a yes output if the serve flag has been set so that the routine exits back to decision block 166 in FIG. 6. Since the beam has not been broken, block 166 provides a no output so that a delay of approximately one half second is provided, as indicated by the block 168, and then the volley subroutine of FIG. 7 is again called up. Player A thus receives a succession of light beams 24 and coincident "whoop" signals, which have a duration of 0.033 seconds followed by a one half second off period, until he intercepts one of these beams with his paddle 50. When player A successfully intercepts his beam a yes output is provided by the decision block 316 which then sets the change side function to zero, as indicated by the block 139. When the change friction is set to zero a light beam will be directed to the opposing player on the same side as the side on which the beam was intercepted by the intercepting player whereas if the change function is one then the beam will be directed to the opposing player on the side opposite from the side on which the intercepting player intercepted the beam.

As discussed generally heretofore the microprocessor determines whether the beam has been intercepted during the first half of the audible "whoop" signal or has been intercepted during the last half of the signal, as indicated by the decision block 140. More particularly, if the frequency at which the beam was broken is less than the mid-range frequency of the audible "whoop" signal a yes signal is provided which changes the change function to one, as indicated by the block 142. On the other hand if the frequency at which the beam was intercepted is beyond the mid-range frequency the change function remains at zero.

As discussed generally heretofore, a delay interval is provided after the beam has been intercepted by one player and before the bounce tone signal is produced, as indicated by the block 144. In accordance with a further aspect of the present invention this delay is not fixed but instead is inversely proportional to the bottom frequency at which the audible "whoop" signal is started, as indicated in the block 144. As discussed heretofore, after every four volleys, i.e., successive interceptions of the beams by the players the bottom frequency is raised by delta f so that not only does the audible "whoop" signal shorten after each group of four volleys but in addition the delays provided both before and after the bounce tone signal are also shortened, thereby progressively increasing the pace of the game and making it more difficult for the players to continue a volley. In this connection it will also be recalled that the duration of each light beam is also shortened in accordance with the shortening of the audible "whoop" signal. This is automatically provided by block 118 which starts the audible signal at a higher bottom frequency and hence shortens the total duration of both the audible "whoop" signal and the light beam. Preferably, the delay introduced by block 118 is approximately one half second with a bottom f of 400 Hz and decreases to approximately one fifth of a second at an upper limit bottom frequency of 1400 Hz.

After the delay introduced by the block 144 the decision block 146 determines whether the change function is one or zero. If the change function is one a high frequency bounce tone is generated by the microprocessor 60 and supplied to the loudspeaker 104, as indicated by the block 148. As discussed generally heretofore, this high frequency bounce tone signal will inform the opposite player that the beam which will be directed to him will be one the opposite side from the side on which the opposing player intercepted his beam. On the other hand, if the change function is zero, indicating that the beam was intercepted during the last half of the audible "whoop" signal, a no output is produced by the block 146 so that a low frequency bounce tone signal is developed, as indicated by the block 150. If a high frequency bounce tone signal is developed it is then necessary to change the side on which the beam directed to the opposing player will be developed, i.e., from forehand to backhand, or vice versa, as indicated by the block 152. On the other hand, if a low frequency bounce tone is developed no change in sides is made. A second delay is then introduced after the bounce tone signal has been produced, as indicated by the block 514, this delay being also inversely proportional to the bottom frequency of the audible "whoop" signal as discussed generally heretofore in connection with the block 118. The microprocessor 60 then changes players, as indicated by the block 156 so that the next beam will be sent to either the forehand or backhand side of the opposing player, depending upon whether or not the change function was one or zero as a result of the previous beam interception.

As discussed generally heretofore, the pace of the game is speeded up by increasing the bottom frequency of the audible "whoop" signal by a factor delta f, preferably 50 Hz, after each four successful volleys of the players. To accomplish this, the microprocessor keeps track of each volley in the counter N and when N equals a multiple of four it provides a yes output from the decision block 158 so that the bottom frequency is then incremented by the factor delta f, as indicated by the block 160. As discussed generally heretofore, the bottom frequency is increased in increments until it reaches a limit frequency, as determined by the decision block 162. Preferably, this upper limit bottom frequency is 1400 Hz. When the bottom frequency reaches this limit frequency the bottom frequency is no longer raised and the audible "whoop" signal and light beam durations continue at this shortened duration until one of the players misses intercepting his beam. With an upper limit bottom frequency of 1400 Hz the audible "whoop" signal and associated light beam will have a duration of approximately one sixth of a second and the delays before and after the bounce tone signal will be one fifth of a second. At such a pace, it will be obvious that the players cannot continue successively intercepting their light beams very long before one of the players misses and loses a point.

During the serving mode the first player receives the audible "whoop" signal and a light beam directed to his forehand side, at spaced intervals until he intercepts one of the beams before it is extinguished. Each time he misses intercepting a beam, the decision block 138 determines that the serve flag is still set and exits the routine to the decision block 166 in FIG. 6 so that the volley subroutine is repeated, as described heretofore. However, when the beam is broken the serving mode should be terminated and a volleying mode established in which each player is given only one chance to intercept his beam or lose a point. Accordingly, when the first player intercepts the beam, the decision block 164 provides a yes output, since the serve flag is still set, and the program exits at 165 back to block 166 which now also provides a yes output. The serve flag is then cleared, as indicated by the block 170 and then the volley routine of FIG. 7 is again called up as indicated by the block 172. The volley routine of FIG. 7 continues to be repeated since the serve flag is no longer set. However, when one of the players does not intercept his beam the routine exits at 174 and the microprocessor 60 makes an appropriate increment to the player's score who last intercepted the beam, as indicated by the block 176. The microprocessor then determines whether or not eleven points have been scored by either player, as indicated by the block 178. If neither player has scored eleven points the microprocessor outputs the score of each player, as indicated by the block 180. As discussed heretofore, such output consists of a light beam directed to the forehand of the first player and then after this beam is turned off the microprocessor provides a coded audible signal to the loudspeaker 104 indicating the number of points that player has scored. Preferably this code comprises a high frequency beep tone signifying five points and a low frequency beep tone signifying one point, the high frequency beep tone being employed to reduce the number of counts which the player must make to determine his score. The microprocessor then flashes the forehand beam of the other player and then provides a coded audible signal for his score in a similar manner. In this connection, it will be understood that any other suitable arrangement, such as digital displays mounted in the housing 20, may be employed in place of the coded audible signal to inform each player of his score.

Since the beam was not broken by the player who loses a point the microprocessor 60 remains programmed to send a beam to him on the same side that he failed to intercept the beam. Accordingly, after the score of both players are announced the program returns to block 114, the serve flag is set and the microprocessor starts serving to the player who lost the last point on the side that he failed to intercept the beam to start the next point of the game.

When one of the players has scored eleven points the microprocessor announces the winner, as indicated by the block 182. As discussed heretofore, this indication is by alternately flashing the forehand and backhand beams of the winning player while at the same time emitting the audible "whoop" signal from the loudspeaker 104.

As discussed generally heretofore, Game No. 2 provides a delay after the "whoop" signal has been terminated and before the player's light beam is turned off so as to give him additional time to intercept the beam, as indicated by the block 130. In other respects Game No. 2 is similar to Game No. 1 described heretofore.

In Game No. 3 a practice routine is established in which the microprocessor first determines if a single player is playing against the computer, as indicated by the block 184 in FIG. 7. The microprocessor then determines whether or not Game 3 has been selected in which a practice routine is established or Game No. 4 in which a solitary player plays a simulated game with the microprocessor, as indicated by the block 186. If Game No. 3 has been selected and a no output is provided from the block 186 the change function is always set to zero, as indicated by the block 188. This means that during the practice routine of Game No. 3 the microprocessor always returns the beam to the practicing player on the same side that he has chosen by intercepting the beam either during the first half or the last half of the audible signal. Thus, if the practicing player intercepts a beam on his forehand side during the first half of the audible "whoop" signal it will be returned by the microprocessor to his backhand side. On the other hand, if he intercepts his forehand beam during the last half of the audible "whoop" signal the microprocessor returns the beam to his forehand side. Since the microprocessor keeps track of the number of volleys in the counter N and always returns a volley the microprocessor can inform the practicing player of the number of volleys before he has failed to intercept the beam. This number of volleys may be outputted to the player in the same manner as his score in block 180, i.e., by means of the coded audible tone signal. After the practicing player misses an interception, the game is started again with the serve mode, as discussed heretofore and then automatically switched to the volleying mode, as described in detail heretofore.

In Game No. 4 a solitary player plays a simulated game against the microprocessor. In this game the block 186 provides a yes output which then means that the microprocessor will randomly change the change function, as indicated by the block 190. Thus, the Game No. 4 the solitary player does not automatically know where the beam will be returned to him but must rely on the high or low frequency bounce tone signals to inform him where the next beam will be directed to his station. In other respects Game No. 4 is similar to a normal game with two players. However, since the computer does not make an error and always returns the beam to the solitary player, the solitary player always misses a point and hence the computer will output the number of volleys when the player misses. In this connection it will be understood that when the computer is playing either Game No. 3 or Game No. 4 the microprocessor 60 is programmed so that the block 136 always provides a yes output indicating that the beam has been broken.

While the best mode of practicing the invention has been described, it will be understood that various modifications may be made therein which are within the true spirit and scope of the invention as defined in the appended claims.

What is claimed as new and desired to be secured by Letters Patent of the United States is:

1. A player response game apparatus, comprising means for selectively generating beams of radiant energy in one of at least two different directions relative to a player station, player operated reflector means for intercepting a light beam from said generating means, means for detecting radiant energy which is reflected back from a player operated reflector means to a location adjacent the source of said one beam, and means responsive to said detecting means for controlling said selective light beam generating means to generate a radiant energy beam directed in the other of said two directions.

2. The game apparatus of claim 1, wherein said beam generating means includes means for selectively generating a plurality of radiant energy beams which originate at a generally central location and diverge outwardly from said central location at different angles relative to said player station.

3. The game apparatus of claim 2, which includes two player stations at opposite sides of said central location, and means at said central location for selectively generating radiant energy beams which diverge outwardly from said control location at different angles relative to each of said player stations.

4. The game apparatus of claim 1, which includes means for generating an audible signal simultaneously with the generation of said one radiant energy beam, and means responsive to the timing of the interception of said one beam by said hand held object relative to said audible signal for controlling the operation of said selective beam generating means.

5. A player response game apparatus, comprising a housing, means within said housing for selectively directing a beam of radiant energy out of said housing in different directions relative to a pair of player stations located on opposite sides of said housing, and means in said housing responsive to radiant energy reflected back to said housing when a beam is intercepted at one of said player stations for automatically directing a beam of radiant energy to the opposite player station.

6. The game apparatus of claim 5, wherein said beam is reflected back to said housing by means of a hand held object which is moved by the player at said one player station to intercept said beam.

7. The game apparatus of claim 6, wherein said hand held object has a radiant energy diffusing surface.

8. The game apparatus of claim 6, wherein said hand held object is paddle shaped.

9. The game apparatus of claim 8, wherein said paddle shaped hand held object has a surface which scatters radiant energy when said beam is intercepted so that a portion of said scattered energy is returned to said housing irrespective of the exact angle at which said object intercepts said beam.

10. The game apparatus of claim 5, which includes means for generating an audible signal while a beam of radiant energy is directed to said one player station, and means responsive to the timing of the interception of said beam relative to said audible signal for varying the direction of said beam directed to the opposite player station.

11. The game apparatus of claim 5, which includes means for generating an audible signal of predetermined duration while a beam of radiant energy is directed to said one player station, means response to interception of said beam during one portion of said audible signal for directing a beam of radiant energy to the opposite player station in a first direction, and means responsive to interception of said beam during another portion of said audible signal for directing a beam of radiant energy to the opposite player's station in a second direction.

12. The game apparatus of claim 11, wherein said first direction corresponds to the same side of a player positioned at said opposite player station as the side on which the beam was intercepted at said one player station and said second direction corresponds to the side of said player at said opposite player station opposite from the side on which the beam was intercepted at said one player station.

13. The game apparatus of claim 12, which includes means for generating a bounce tone signal before said beam is directed to said opposite player station to prepare the player at said opposite player station to intercept said beam when it is directed to said opposite player station.

14. The game apparatus of claim 13, wherein said bounce tone signal has a first frequency when said beam is to be directed to said same side of said opposite player station and has a second frequency when said beam is to be directed to said opposite side of said opposite player station.

15. The game apparatus of claim 13, wherein said bounce tone signal has different characteristics depending upon whether said beam is to be directed to said same side of said opposite player station or said opposite side of said opposite player station.

16. The game apparatus of claim 11, wherein said audible signal increases in frequency during the duration thereof.

17. The game apparatus of claim 11, wherein said audible signal increases in frequency by predetermined increments over the duration thereof.

18. The game apparatus of claim 11, wherein said audible signal is terminated when a predetermined top frequency is reached.

19. The game apparatus of claim 18, wherein said beam directed to said one player station is extinguished when said audible signal is terminated.

20. The game apparatus of claim 18, wherein said beam directed to said one player station is extinguished a predetermined time interval after said audible signal is terminated.

21. The game apparatus of claim 20, wherein the provision of said time interval is controlled by switch means on said housing.

22. The game apparatus of claim 5, which includes means for generating a bounce tone signal before said beam is directed to said opposite player station to prepare the player at said opposite player station to intercept said beam when it is directed to said opposite player station.

23. The game apparatus of claim 22, wherein said bounce tone signal is generated a predetermined time interval after said beam is intercepted at said one player station.

24. The game apparatus of claim 19, including delaying means for directing said beam to said opposite player station a predetermined time interval after generation of said bounce tone signal.

25. The game apparatus of claim 5, which includes means responsive to termination of one of said beams without being intercepted at one of said player stations for generating an audible signal indicating that the player at the other player station has scored a point.

26. The game apparatus of claim 5, which includes means for determining when a predetermined number of successive interceptions of the beams directed to said pair of player stations has occurred and means responsive to a predetermined number of successive interceptions of the beams directed to said pair of player stations for shortening the duration of beams thereafter successively directed to said pair of player stations.

27. The game apparatus of claim 2, which includes means for repeatedly shortening the duration of the beams successively directed to said player stations in response to each predetermined number of successive interceptions of said beams at said player stations.

28. The game apparatus of claim 5, including means for determining when a beam is first initiated and means for producing an audible signal which starts at a predetermined bottom frequency when a beam is first initiated and rises to a predetermined top frequency at which the beam is terminated.

29. The game apparatus of claim 28 which includes means for raising said bottom starting frequency of said audible signals a predetermined increment in response to a predetermined number of successive interceptions of said beams at said player stations, thereby to decrease the duration of succeeding audible signals and beams directed to said player stations.

30. The game apparatus of claim 29, which includes means for terminating further increase of said bottom starting frequency of said audible signal after a predetermined number of said incremental raises thereof.

31. The game apparatus of claim 5, which includes means for designating one of said player stations as the first player station of the game, and means for repetitively directing said beam to said one player station at spaced intervals until said radiant energy responsive means receives energy reflected back to said housing by interception of said beam at said one player station.

32. The game apparatus of claim 31, which includes means for developing an audible signal of predetermined duration during each interval that said beam is directed to said one player station, and means responsive to the timing of the interception of said beam relative to said audible signal for varying the direction in which a beam is directed to the opposite player station.

33. The game apparatus of claim 31, wherein said beam is intercepted by interposing a hand held object in said beam which reflects radiant energy from said beam back to said radiant energy responsive means in said housing.

34. The game apparatus of claim 33, wherein said hand held object is paddle shaped and has a radiant energy diffusing surface.

35. The game apparatus of claim 31, including means for increasing the frequency of said audible signal during said predetermined duration, means responsive to interception of said beam during a low frequency portion of said audible signal for directing a beam to the opposite player station on the side opposite from the beam interception side, and means responsive to interception of said beam during a high frequency portion of said audible signal for directing a beam to the opposite player station on the same side as the beam interception side.

36. A player response game apparatus, comprising a housing, means within said housing for selectively generating a plurality of beams of radiant energy which extend from said housing in different directions, a first pair of said beams extending on either side of a first player station located on one side of said housing and a second pair of said beams extending on either side of a second player station located on the opposite side of said housing, player operated reflector means for intercepting one of said beams of radiant energy, means in said housing for detecting radiant energy reflected back to said housing when one of said beams is intercepted by said player, and means controlled by said detecting means for controlling said light beam generating means.

37. A player response game apparatus, comprising central means positioned between two player stations for selectively generating light beams which are aimed in different directions relative to said player stations, player operated reflective means for intercepting said beams of light, means for detecting light reflected from a player operated reflective means, and means response to the output of said detector means for controlling said beam generating means to generate a light beam aimed at the opposite player station.

38. The game apparatus of claim 37, which includes latch means responsive to the output of said detecting means for developing a control signal in response to detection of reflected light by said detecting means, and means for controlling said beam generating means in accordance with said control signal.

39. The game apparatus of claim 37, wherein said beam generating means is capable of directing a light beam in two different directions relative to said one player station, and said detecting means is responsive to light reflected from a player operated reflective means which intercepts a light beam in either of said two different directions at said one player station.

40. The game apparatus of claim 39, wherein the axes of light beams directed in said two different directions are approximately 90° apart.

41. The game apparatus of claim 37, which includes means for detecting light reflected from a hand held object which intercepts said light beam aimed at said opposite player station, and latch means connected to the output of both of said detecting means for developing a control signal in response to interception of a light beam at either of said pair of player stations.

42. The game apparatus of claim 37, which includes pulse stretching means connected to the output of said detecting means for developing a control pulse of relatively long duration in response to said reflected light, and means controlled by said control pulse for controlling said light beam generating means.

43. The combination of claim 42, which includes latch means controlled by said control pulse for developing an output control signal, and means controlled by said output control signal for controlling said light beam generating means.

44. An electronic table tennis game, comprising a housing positioned between opposing player stations, means within said housing for directing a light beam to either the forehand or backhand side of a player at either of said player stations, a mode select switch operative to select a serving or a volley mode, means operated during a serving mode for controlling said beam directing means so that a beam of relatively short duration is repetitively directed to one side of a player at a first one of said stations, player operated reflector means for intercepting one of said beams of radiant energy, and means operative during a volley mode and responsive to interception of one of said short duration beams by a player at said one station for controlling said beam directing means to direct a light beam of relatively short duration to the opposite player station.

45. The electronic table tennis game of claim 44, which includes means operated during said volley mode for successively directing a light beam of relatively short duration to the opposite player station in response to interception of a beam by a player at one of said stations until one of said beams is not intercepted by a player at one of said stations.

46. The electronic table tennis game of claim 45, which includes means for scoring a point for the player opposite the player station at which the beam was not intercepted.

47. The electronic table tennis game of claim 46, wherein said point scoring means comprises means for directing a light beam to said opposite player and thereafter developing an audible signal indicating the point score of said opposite player.

48. The electronic table tennis game of claim 47, wherein said audible signal comprising a series of tone signals that indicate the point score of said opposite player.

49. The electronic table tennis game of claim 45, which includes means for repeating said serve and volley modes, and means operative after each set of serve and volley modes for developing scoring signals indicating the point score of each of said players.

50. The electronic table tennis game of claim 49, wherein said scoring signal developing means comprise means for directing a light beam to each of said players followed by a series of tone signals that indicate the number of points scored by the players to which said beam is directed.

51. The electronic table tennis game of claim 50, wherein said audible signal comprises one or more tone components of relatively high frequency each signifying a group of scoring points and one or more low frequency tone components each signifying one scoring point.

52. The electronic table tennis game of claim 49, which includes means responsive to the scoring of a predetermined number of points by one of said players for developing a signal indicating the end of the game.

53. The electronic table tennis game of claim 52, wherein said end of game signal developing means comprises means for alternately directing light beams to the forehand and backhand side of the winning player.

54. The electronic table tennis game of claim 53, wherein said end of game signal developing means also comprises means for developing an audible signal of increasing frequency.

55. The electronic table tennis game of claim 44, wherein said beam generating means includes means in said housing for detecting light reflected back to said housing from an object held by a player at said one station when said object is moved by said player to intercept said beam.

56. The electronic table tennis game of claim 55, wherein said object is paddle shaped and has a light reflective surface.

57. The electronic table tennis game of claim 56, wherein said light reflective surface comprises light diffusing means operative to reflect back to said housing a portion of the intercepted light beam irrespective of the exact angle at which said paddle shaped object intercepts said beam.

58. An electronic table tennis game, comprising a housing positioned between opposing player stations, means within said housing for directing a light beam to either the forehand or backhand side of a player at either of said player stations, player operated reflector means for intercepting one of said beams of radiant energy, and means for successively controlling said beam directing means to direct a light beam to opposite player station in response to the interception of a beam directed to either the forehand or backhand side of a player at one of said stations.

59. The electronic table tennis game of claim 58, including means for controlling said beam directing means to cease directing light beams to either of said player stations if a light beam directed to one of said player stations is not intercepted by a player at said one station.

60. The electronic table tennis game of claim 58, which includes means for generating an audible signal of predetermined duration while a light beam is directed to one of said player stations, means responsive to interception of the beam during one portion of said audible signal for controlling said light beam directing means to direct a light beam to the same side of a player at the opposite station, and means responsive to interception of the beam during another portion of said audible signal for controlling said light beam directing means to direct a light beam to the opposite side of a player at the opposite station.

61. The electronic table tennis game of claim 58, which includes means for generating a bounce tone signal after a beam is intercepted at one station and before a beam is directed to the opposite station.

62. The electronic table tennis game of claim 61, including means for producing distinguishable bounce tone signals wherein said bounce tone signal has a first predetermined characteristic when the beam is to be directed to the side of the player at said opposite station which corresponds to the side at which the beam was intercepted at said one station and a second predetermined characteristic when the beam is to be directed to the side of the player at said opposite station which is opposite to the side at which the beam was intercepted at said one station, thereby to prepare the player at said opposite station to intercept the beam directed to either his forehand or backhand side.

63. The electronic table tennis game of claim 62, wherein said producing means includes means for creating a bounce tone signal of relatively low frequency and means for creating another bounce tone signal of relatively high frequency.

64. The electronic table tennis game of claim 61, wherein including delay means for delaying the generation of said bounce tone signal for a predetermined time interval after said beam is intercepted at said one player station.

65. The electronic table tennis game of claim 61, wherein said beam is directed to said opposite player station a predetermined time interval after generation of said bounce tone signal.

66. The electronic table tennis game of claim 58, including means for detecting the interception of the beam at the station during a first portion of the beam, means responsive to the detection of interruption of the beam at a station during a first portion of the beam for controlling said light beam directing means to direct a light beam to the same side of the player at the opposite station, and means responsive to interception of the beam at said one station during a second portion of the beam for controlling said light beam directing means to direct a light beam to the opposite side of the player at said opposite station.

* * * * *